US007434294B2

(12) United States Patent
Naito et al.

(10) Patent No.: US 7,434,294 B2
(45) Date of Patent: Oct. 14, 2008

(54) SUCTION OPENING BODY AND ELECTRIC CLEANER

(75) Inventors: Junji Naito, Kanagawa (JP); Takayuki Ichino, Kanagawa (JP); Yoshitaka Sugiyama, Kanagawa (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 267 days.

(21) Appl. No.: 10/563,383

(22) PCT Filed: Jul. 9, 2004

(86) PCT No.: PCT/JP2004/009795

§ 371 (c)(1),
(2), (4) Date: Jan. 5, 2006

(87) PCT Pub. No.: WO2005/004695

PCT Pub. Date: Jan. 20, 2005

(65) Prior Publication Data

US 2006/0162121 A1 Jul. 27, 2006

(30) Foreign Application Priority Data

Jul. 9, 2003 (JP) ..... 2003-194507

(51) Int. Cl.
*A47L 9/02* (2006.01)
*A47L 5/00* (2006.01)
*A47L 9/00* (2006.01)

(52) U.S. Cl. ..... 15/418; 15/422.1; 15/325

(58) Field of Classification Search ..... 15/418, 15/416, 422, 422.1, 325
See application file for complete search history.

(56) References Cited

U.S. PATENT DOCUMENTS 2,273,883 A * 2/1942 Norrick ..... 15/325
2,324,111 A * 7/1943 Ross ..... 15/371
2,659,925 A * 11/1953 Wood ..... 15/418
4,254,525 A * 3/1981 Combest ..... 15/1.7
4,416,034 A * 11/1983 Ahlf et al. ..... 15/354
4,499,628 A * 2/1985 Platt ..... 15/419

(Continued)

FOREIGN PATENT DOCUMENTS

CN 1498581 A 5/2004

(Continued)

OTHER PUBLICATIONS

English translation of Chinese Office Action issued for corresponding Chinese Patent Application, dated Jul. 6, 2007, 7 pages.

*Primary Examiner*—Joseph J. Hail, III
*Assistant Examiner*—Bryan R Muller
(74) *Attorney, Agent, or Firm*—Frishauf, Holtz, Goodman & Chick, P.C.

(57) ABSTRACT

A suction inlet unit comprises a suction inlet main body having a bottom suction inlet, a front suction inlet formed continuously with said bottom suction inlet in the front of said suction inlet main body, and a cover for covering the front suction inlet. The cover, provided at the suction inlet main body to be movable by an adjusting mechanism for adjusting an opening area size of said front suction inlet to a determined area, is configured to decrease the opening area of the front suction inlet when a front portion of the cover is contacted by a wall or furniture.

10 Claims, 10 Drawing Sheets

U.S. PATENT DOCUMENTS

| | | | | |
|---|---|---|---|---|
| 4,912,805 | A * | 4/1990 | Krasznai et al. | 15/392 |
| 5,084,934 | A * | 2/1992 | Lessig et al. | 15/325 |
| 7,171,723 | B2 * | 2/2007 | Kobayashi et al. | 15/325 |
| 2004/0083574 | A1 * | 5/2004 | Kobayashi et al. | 15/354 |

FOREIGN PATENT DOCUMENTS

| | | | |
|---|---|---|---|
| EP | 0553896 | A | 8/1993 |
| EP | 1 415 583 | A1 | 5/2004 |
| GB | 457394 | A | 11/1936 |
| JP | 42-16524 | | 9/1942 |
| JP | 45-10303 | | 5/1979 |
| JP | 56-104628 | A | 8/1981 |
| JP | 61-37394 | Y2 | 10/1986 |
| JP | 1-149757 | U | 10/1989 |
| JP | 2-249517 | A | 10/1990 |
| JP | 11-206635 | A | 8/1999 |
| JP | 2002-000512 | A | 1/2002 |
| JP | 2003-93282 | A | 4/2003 |
| JP | 2003093282 | A * | 4/2003 |
| JP | 2004-141536 | A | 5/2004 |

* cited by examiner

SUCTION OPENING BODY AND ELECTRIC CLEANER

This application is a U.S. National Phase Application under 35 USC 371 of International Application PCT/JP2004/009795 filed Jul. 9, 2004.

TECHNICAL FIELD

The present invention relates to a suction inlet unit having a bottom suction inlet and a front suction inlet, and an electric vacuum cleaner including the suction inlet unit.

BACKGROUND ART

Conventionally, a suction inlet unit having a structure as shown in FIG. 10 is disposed on an electric vacuum cleaner (see, for example, Japan Patent laid-Open No. H11-206,635).

The suction inlet unit 1 includes a suction inlet main body 4 provided with a suction chamber 3 having a bottom suction inlet 2 in a bottom surface 1A, and a rotary cleaning body 5 which is provided rotating in the suction chamber 3. The rotary cleaning body 5 is rotated counterclockwise (as shown in FIG. 10) by air drawn in from an air-sucking inlet 6 provided in the suction inlet main body 4.

According to the suction inlet unit 1, because dust attached to a carpet is beaten up with rotations of the rotary cleaning body 5, so the dust can be efficiently sucked with air through the bottom suction inlet 2.

However, since the above suction inlet unit 1 has a front wall section 4A formed in the front of the suction inlet main body 4, and when the suction inlet unit 1 is being moved forwards, the front wall section 4A may push the dust on a cleaning surface forwards. Thus, there arises such a problem that the forwardly pushed dust can not be efficiently sucked, which seriously affects suction efficiency in sucking the dust. Furthermore, there is a bottom wall section 4B formed between an anterior edge 2*a* of the bottom suction inlet 2 and a front surface of the suction inlet main body 4, thus there arises another problem that the dust existing near a wall can not be sucked.

DISCLOSURE OF THE INVENTION

The present invention has been made in a view of the aforementioned problems, and accordingly, it is an object of the present invention to provide a suction inlet unit and an electric vacuum cleaner which can prevent dust on a cleaning surface from being pushed forwards when the suction inlet unit is being moved forward, and can efficiently suck dust near a wall.

To attain the above object, the suction inlet unit according to the present invention is characterized in that it comprises a suction inlet main body having a bottom suction inlet, and a front suction inlet formed continuously with the bottom suction inlet in the front of the suction inlet main body, an opening area of the front suction inlet is configured adjustable.

In detail, the suction inlet unit comprises a suction inlet main body having a bottom suction inlet, a front suction inlet formed continuously with the bottom suction inlet in the front of the suction inlet main body, and an adjusting mechanism for adjusting opening area of the front suction inlet by moving at least one part of a wall section forming the front suction inlet.

The at least one part of the wall section includes a cover for covering part of the front suction inlet formed in the front of the suction inlet unit, and the adjusting mechanism is configured to be capable of freely adjusting the opening area of the front suction inlet by moving the cover to any position of wide opening area or to any position of narrow opening area.

Also, the suction inlet unit according to the present invention is characterized in that it comprises a suction inlet main body having a suction chamber with a bottom suction inlet; a rotary cleaning body provided rotating in the suction chamber and having a cleaning member; a front suction inlet formed continuously with the bottom suction inlet in the front of the suction inlet main body; and the adjusting mechanism for adjusting positions of at least one part of the wall section forming the front suction inlet so that one part of the rotary cleaning member can protrude ahead through the front suction inlet, or not protrude out.

Furthermore, the suction inlet unit according to the present invention is characterized in that it comprises a suction inlet main body which includes a suction chamber having a bottom suction inlet and a front suction inlet formed continuously with the bottom suction inlet; a rotary cleaning body provided rotating in the suction chamber and having a cleaning member; and the adjusting mechanism for adjusting an opening area size of the front suction inlet. In other words, when a front portion of the suction inlet main body is pushed contacting with a wall or furniture etc, the adjusting mechanism adjusts the opening area size of the front suction inlet by decreasing the opening area so that at least one part of the cleaning member of the rotary cleaning body can protrude ahead of the suction inlet main body through the front suction inlet.

Even further, the present invention is characterized in that it provides an electric vacuum cleaner comprising a suction inlet unit with above-mentioned configurations.

As already described above, according to the present invention, the cover is configured so that the opening area of the front inlet of the suction inlet main body are decreased when the suction inlet unit is pushed forward, causing the suction inlet main body to contact with a wall or furniture, thus the dust on the cleaning surface is prevented from being pushed forwards and the dust near the wall are also sucked in efficiently by a strong suction force.

Moreover, when a front portion of the suction inlet main body is pushed contacting with the wall or furniture, the cover is pushed backward and at least one part of the cleaning member of the rotary cleaning body protrudes from the front suction inlet ahead of the suction inlet unit ensuring that the dust near wall K will be scraped out and brushed with certain by the cleaning member.

BEST MODE FOR CARRYING OUT THE INVENTION

Hereinafter, modes for carrying out a suction inlet unit according to the present invention and an electric vacuum cleaner with the suction inlet unit disposed thereon will be explained in detail with reference to the drawings.

Figure 1:
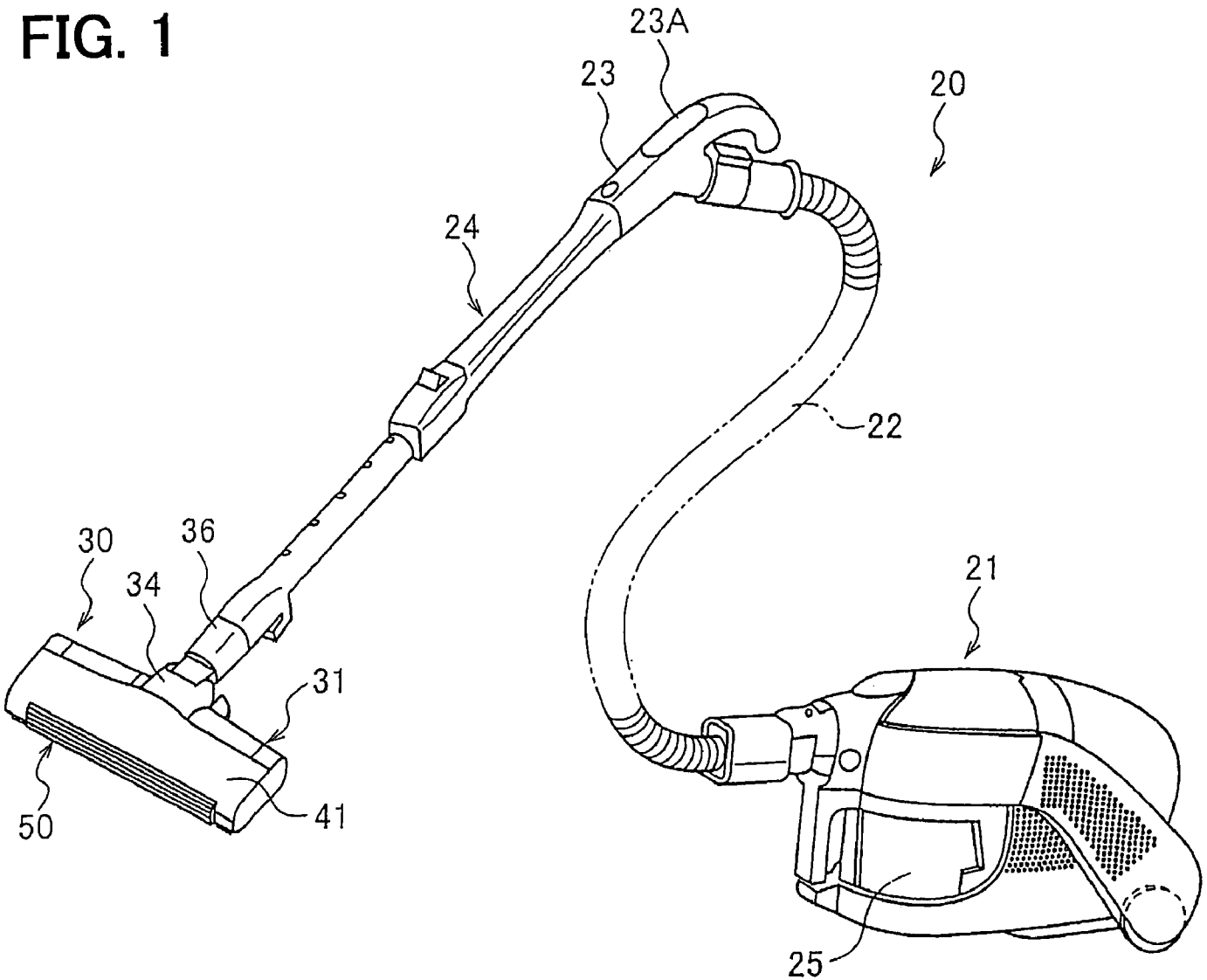
FIG. 1 is a perspective view showing an exterior of an electric vacuum cleaner according to the present invention.

FIG. 1 shows the electric vacuum cleaner 20 to which the suction inlet unit 30 of the present invention is applied. The electric vacuum cleaner 20 comprises a vacuum cleaner main body 21, a hose 22 with one end thereof detachably connected to the vacuum cleaner main body 21 and a hand-held operating pipe 23 provided at the other end thereof, and an extension tube 24 detachably connected to the hand-held operating pipe 23. The suction inlet unit 30 is detachably connected to a leading end portion of the extension tube 24.

An operating section 23A is provided on the hand-held operation pipe 23. On the operating section 23A, there are provided operating switches and buttons (not shown) for operating the electric vacuum cleaner.

In the vacuum cleaner main body 21, there are provided a dust collecting chamber 25 and an electric air blasting machine (not shown) for sending dust to the dust collecting chamber 25 for collection. The dust collecting chamber 25 is provided with free detachability in the vacuum cleaner main body 21.

Figure 2:
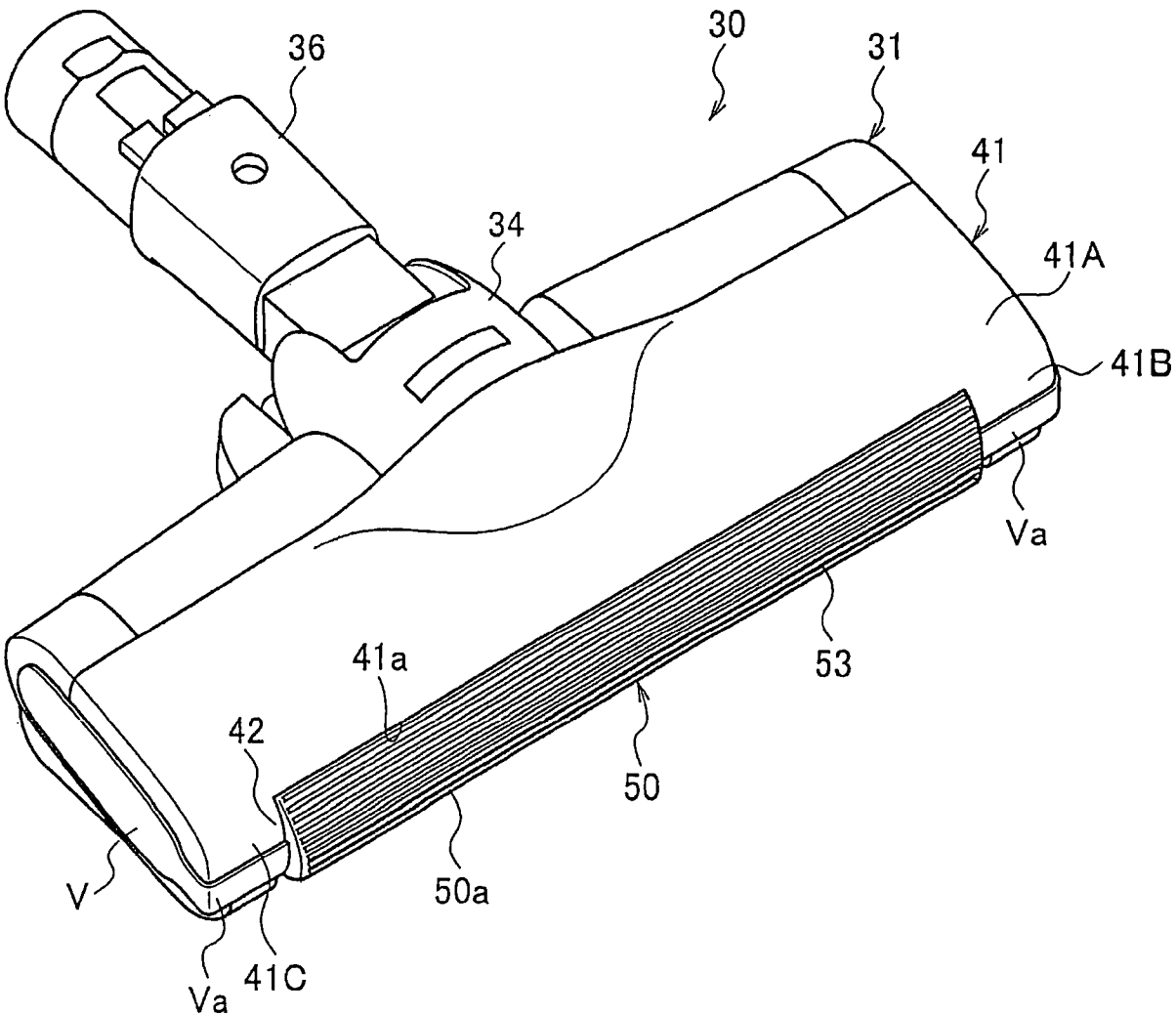
FIG. 2 is a perspective view showing a suction inlet unit of the electric vacuum cleaner shown in FIG. 1.
Figure 3:
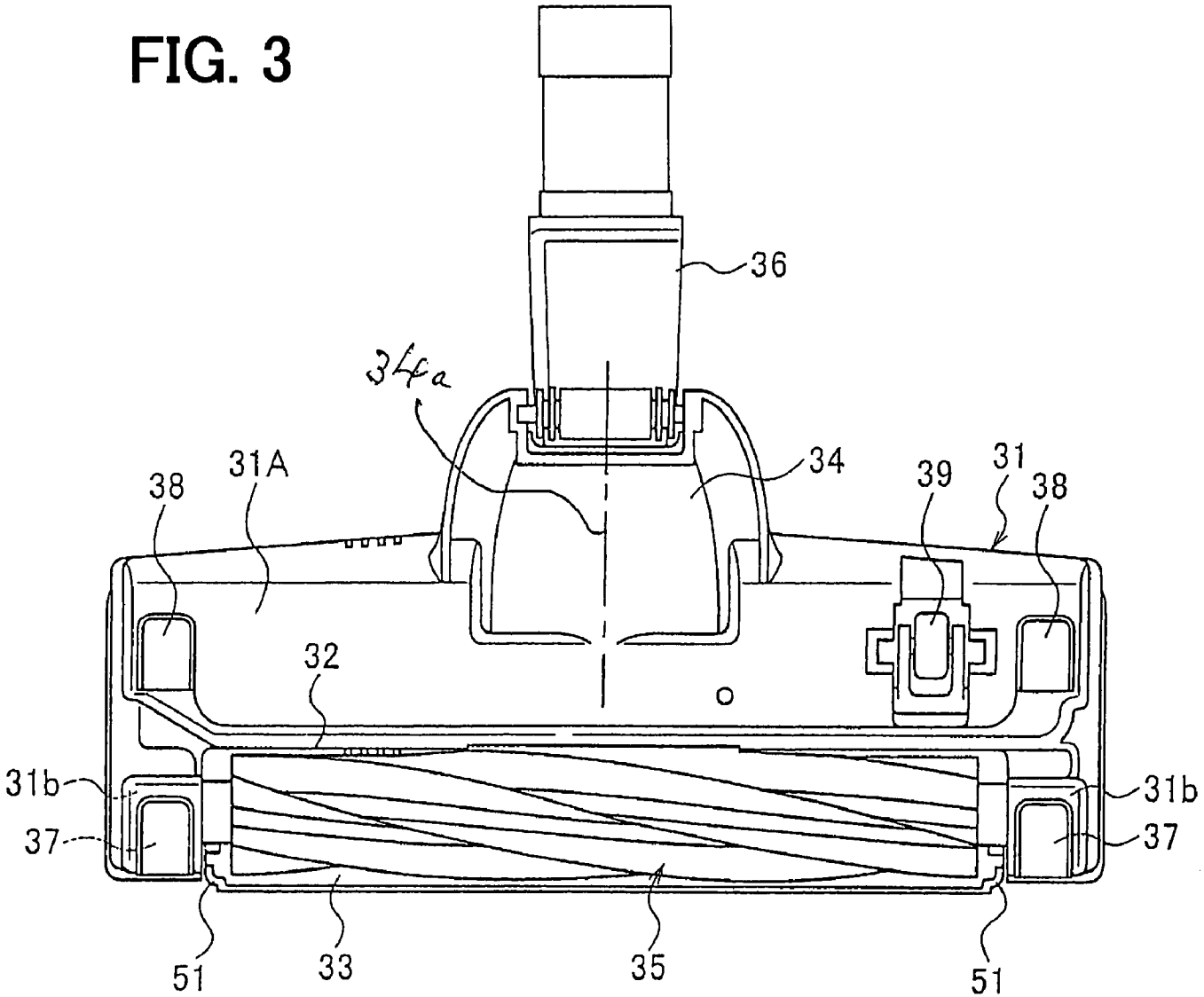
FIG. 3 is a bottom view showing a bottom of the suction inlet unit shown in FIG. 2.
Figure 4:
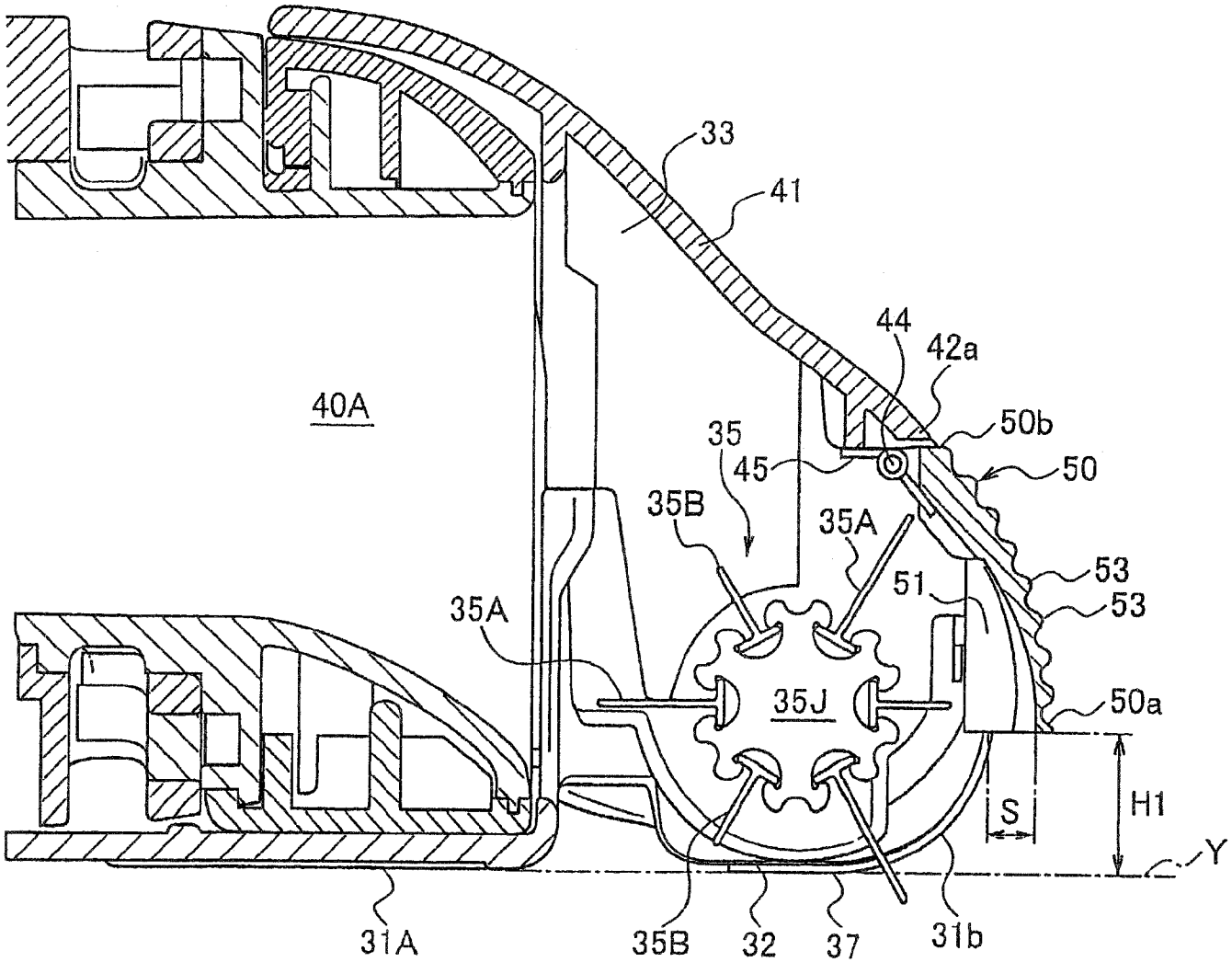
FIG. 4 is a section view showing a configuration of the suction inlet unit shown in FIG. 2.

As shown in FIG. 2 to FIG. 4, the suction inlet unit 30 comprises a suction inlet main body 31, a rotary cleaning body 35 (see FIG. 4), a rotary pipe 34 and an extension pipe 36. The suction inlet main body 31 includes a suction chamber 33 having a bottom suction inlet 32 formed at a bottom surface 31A (see FIG. 3) facing a cleaning surface during cleaning. The rotary cleaning body 35 is provided rotating freely in the suction chamber 33. The rotary pipe 34 is provided rotatable around an axis 34*a* (see FIG. 3) extended in an anteroposterior direction from a back portion of the suction inlet main body 31. The extension pipe 36 is provided attaching to the rotary pipe 34 and being able to move upward and downward along the axis line 34*a*. In addition, as shown in FIG. 2, "V" represents a bumper provided on the suction inlet unit 30 and "Va" represents a front end surface of the bumper.

As shown in FIG. 3, at left and right sides of the bottom suction inlet 32 in the bottom surface 31A of the suction inlet main body 31, there are formed arc-shaped wall sections 31*b* and 31*b* in which cleaning members 37 and 37 having brush-ups are provided, and at both sides of a back part of the bottom surface 31A, there are provided cleaning members 38 and 38 having brush-ups. The above cleaning members 37 to 38 form a movable object which provides an auxiliary function when inserted to the bottom suction inlet 32 for preventing dust on a cleaning surface Y such as a floor etc from running off particularly two sides of the suction inlet main body 31 when it is being moved smoothly together with the suction inlet unit 30.

Furthermore, at one side, for example a right-hand side (as shown in FIG. 3) of the bottom surface 31A of the suction inlet main body 31, a roller 39 is provided for detecting whether or not the suction inlet unit has been placed on the cleaning surface Y. The roller 39 is provided in the bottom surface 31A and configured as being protruded from the bottom surface 31A and movable in a vertical direction (as shown in FIG. 3, a direction perpendicular to the paper surface). When the suction inlet unit 30 is placed on the cleaning surface and in a contacting state with the cleaning surface, the roller 39 is pushed upward to switch on a detecting means (not shown), thus it will be detected that the suction inlet unit 30 has been placed on the cleaning surface.

The rotary cleaning body 35 is set as being driven to rotate by a motor (not shown). If the roller 39 can not detect that the suction inlet unit 30 has been placed on the cleaning surface, the driving motor will be stopped by the above detecting means and as a result of this, the rotations of the rotary cleaning body 35 will be stopped.

The rotary cleaning body 35 comprises a pivot section 35J and a plurality of cleaning members provided along a circular direction around the pivot section with equal spacing. The cleaning members in one group have same size in length, while the cleaning members in other group have different size in length from those in a different group. More specifically, the cleaning members, for example, as shown in figures of the embodiment, includes a plurality of cloth cleaning members 35A having brush-ups and a plurality of brushes 35B. The length of the cleaning members 35A is set longer than that of the brushes 35B. Thus, the cleaning members 35A are easier to bend than the brushes 35B and as a result they will have a weaker force in scraping out the dust than the brushes 35B. The longer cleaning members 35A are protruded downward longer than the cleaning members 37 and 38, while the shorter cleaning members 35B are not protruded out compared with the cleaning members 37 and 38. The cleaning members 35A contact with the cleaning surface such as plate gaps or mats and scrape out the dust thereon, while the brushes 35B which are mainly configured to contact with the cleaning surface such as carpets and scrape out the dust thereon will not contact with them. Thus, the cleaning members 35A are suitable in cleaning plate gaps or mats and the brushes 35B are suitable in cleaning carpets.

Here, the cleaning members 35A and brushes 35B are set to beat the cleaning surface from front to back direction, in other words, the rotary cleaning body 35 as shown in FIG. 4 is configured rotating in a clockwise direction. As a result, the dust in front of the rotary cleaning body 35 will be scraped into the bottom suction inlet 32 by the cleaning members 35A and brushes 35B.

Figure 5:
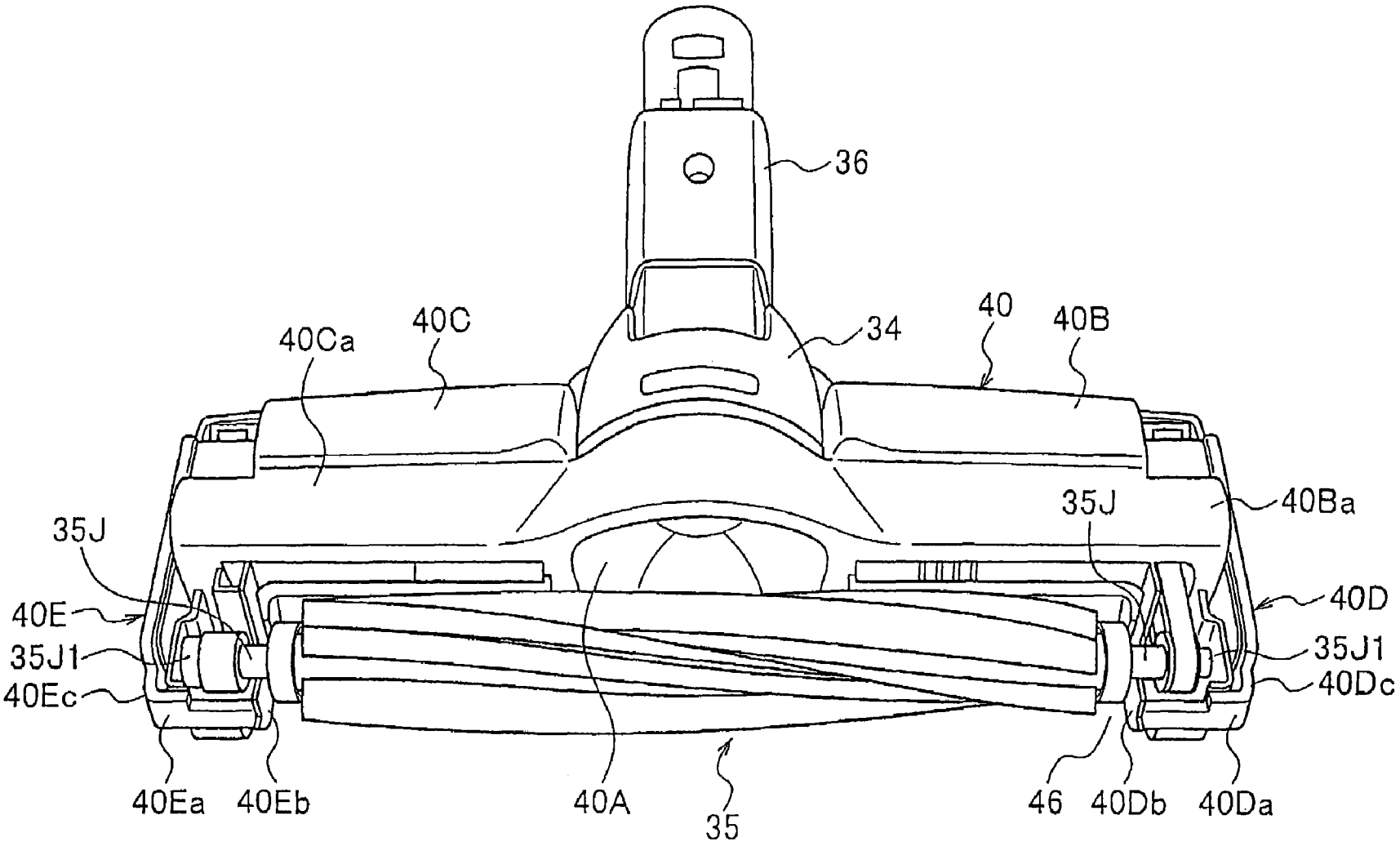
FIG. 5 is a perspective view showing a main body case of the suction inlet unit with a cover case taken off.
Figure 6:
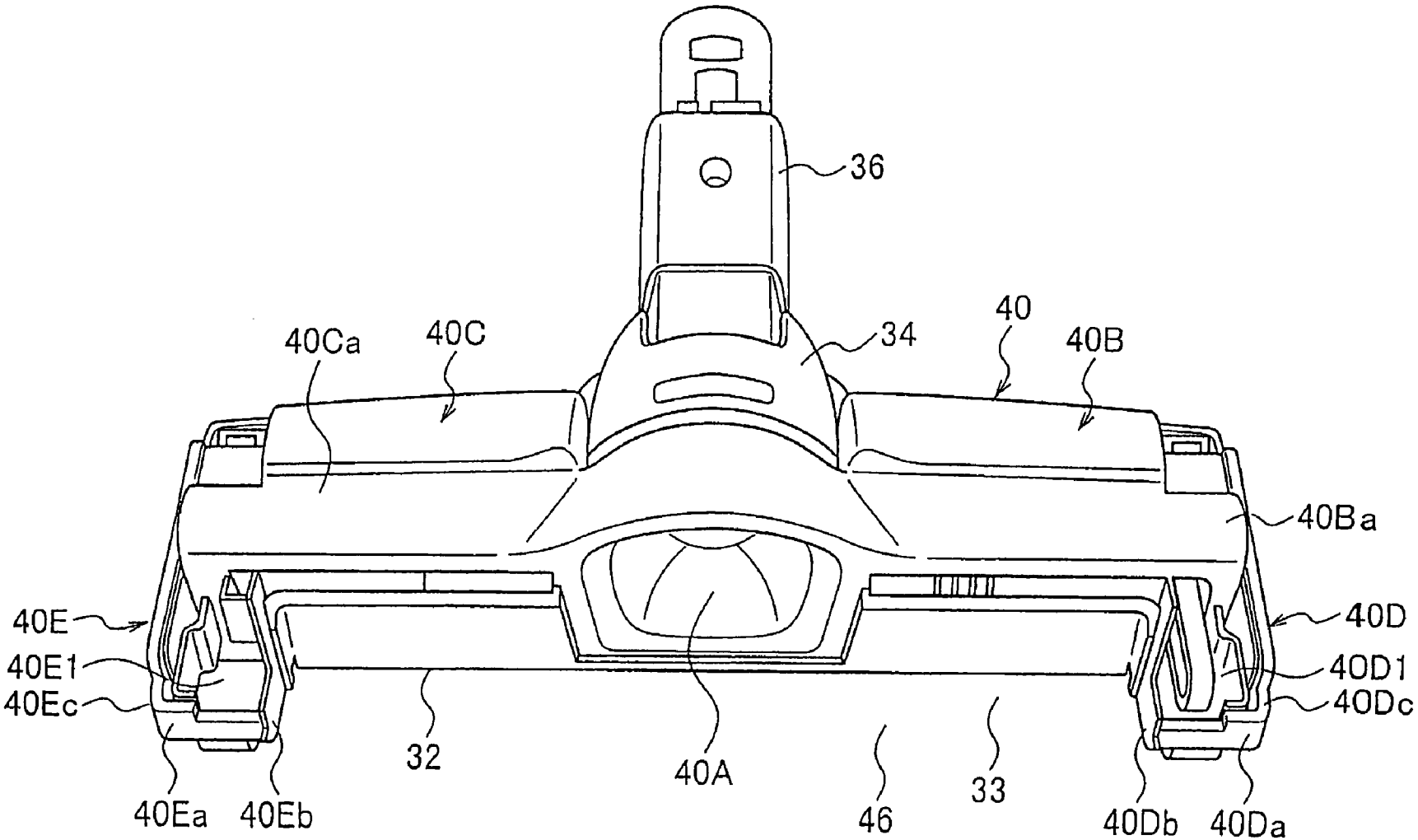
FIG. 6 is a perspective view showing the main body case of the suction inlet unit with the cover case and a rotary cleaning body taken off.

The suction inlet main body 31 comprises a main body case 40 provided at the rotary pipe 34 (as shown in FIG. 5 and FIG. 6) and a cover case 41 (see FIG. 2 and FIG. 7) disposed with free detachability above the main body case 40. The main body case 40 and cover case 41 form the suction chamber 33. The upper and front faces become open when the cover case 41 is removed from the main body case 40, which enables simple operations such as the removing of thread trashes adhered to the rotary cleaning body 35 and the taking-out of the rotary cleaning body 35.

The main body case 40 comprises a wind-drawing pipe 40A which communicates between the suction chamber 33 and the rotary pipe 34, a motor chamber section 40B disposed at a right-hand side of the wind-drawing pipe 40A, a controlling chamber section 40C disposed at a left-hand side of the wind-drawing pipe 40A, a roller bearing chamber section 40D protruding forward from one end portion (right-hand end portion in FIG. 6) of the motor chamber section 40B, and a roller bearing chamber section 40E protruding forward from another end portion (left-hand end portion in FIG. 6) of the controlling chamber section 40C.

The roller bearing chamber section 40D includes a front end wall section 40Da, an inner side wall section 40Db and an outer side wall section 40Dc. Similarly, the roller bearing chamber section 40E includes a front end wall section 40Ea, an inner side wall section 40Eb and an outer side wall section 40Ec.

There exists a front suction inlet 46 (see FIG. 5 and FIG. 6) in the front of the suction inlet main body 31. The front suction inlet 46 is formed from a space which is enclosed by a concave section 42 of the cover case 41 between the front end wall section 40Da of the roller bearing chamber section 40D and the front end wall section 40Ea of the roller bearing chamber section 40E, and a later described cover 50 coving the space. The front suction inlet 46 is provided continuously with the bottom suction inlet 32 for sucking the dust in front of the suction inlet main body 31. The detailed description of the front suction inlet 46 will be explained hereinafter.

A motor (not shown) for rotating the rotary cleaning body 35 is disposed inside the motor chamber section 40B and a controlling circuit (not shown) for controlling the motor is disposed in the controlling chamber section 40C.

The case cover 41 includes a top panel section 41A covering the wind-drawing pipe 40A, a front side portion 40Ba of the motor chamber section 40B, a front side portion 40Ca of the controlling chamber section 40C, the suction chamber 33 and upper portions of the roller bearing chamber sections 40D and 40E. The case cover 41 also includes front wall sections 41B and 410 which are formed at two sides of a front end 41*a* (as shown in FIG. 2) of the top panel section 41A, bending downwards and jointing with the front end wall sections 40Da and 40Ea of the respective roller bearing chamber sections 40D and 40E. The concave section 42 is disposed in the front of the cover case 41 between the front wall sections 41B and 41C with determined height and width.

Figure 7:
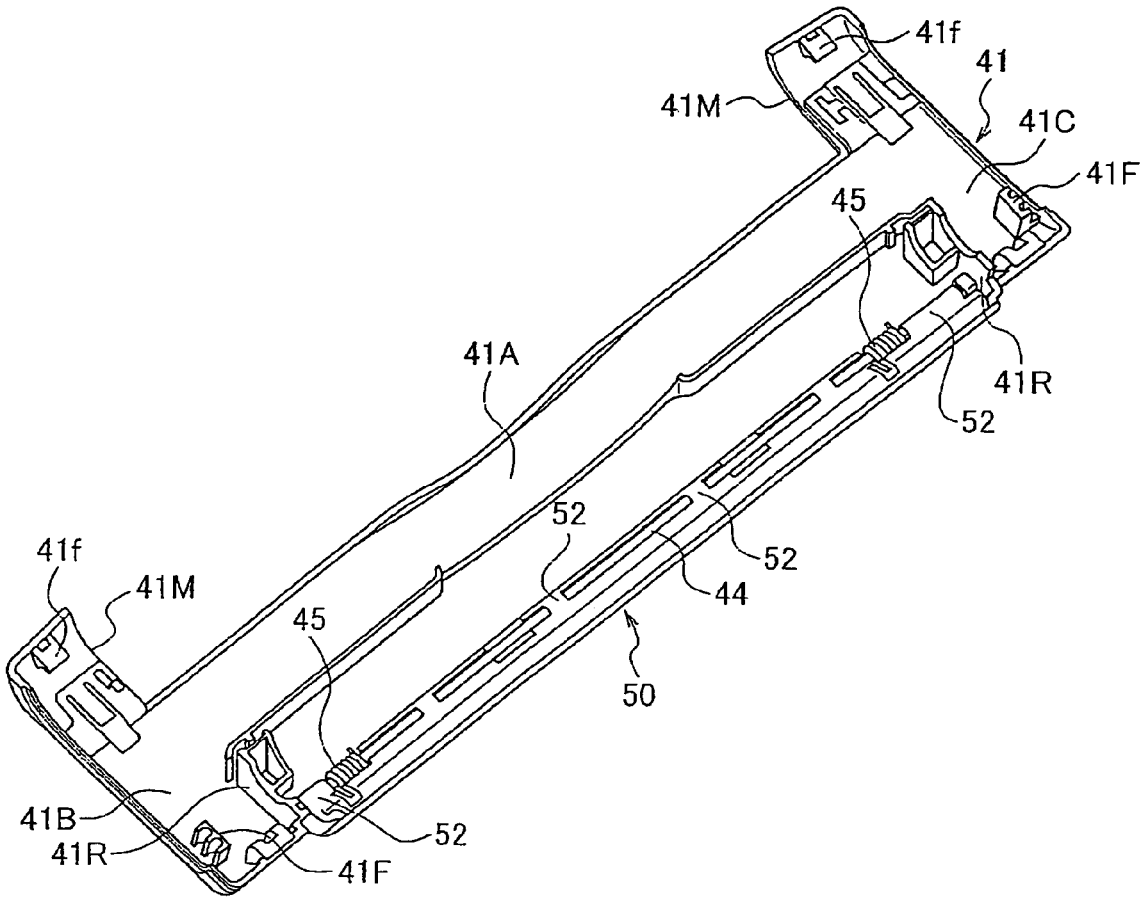
FIG. 7 is a perspective view showing an inner side of the cover case.

As shown in FIG. 7, partition ribs 41R and 41R, and pressing sections 41F and 41F are disposed in an inner side of the top panel section 41A of the cover case 41. The partition ribs 41R and 41R join with inner side wall sections 40Db and 40Eb of the respective roller bearing chamber sections 40D and 40E, partitioning the suction chamber 33 from roller bearing chamber 40D1 and 40E1 of the respective roller bearing chamber section 40D and 40E. The pressing sections 41F and 41F press upward roller bearing sections 35J1 and 35J1 which hold the pivot section 35J of the rotary cleaning body 35 for rotating freely. At both sides of a back portion of the top panel section 41A there are formed respective arm sections 41M and 41M extending backwards. Hooks 41*f* and 41*f* for mounting the cover case 41 to the main body case 40 are provided at respective inner sides of front end portions of the arm sections 41M and 41M. Two end portions extending from either side of a shaft 44 are attached to the partition ribs 41R and 41R.

For a purpose of adjusting opening area size of the front suction inlet 46, an adjusting mechanism is disposed for moving at least one part of a wall section forming the front suction inlet 46. The suction force of the front suction inlet 46 varies, with variation on the opening area size of the front suction inlet 46.

The adjusting mechanism comprises at least one part, e.g. the cover 50, of the wall section forming the front suction inlet 46 and a moving means for moving the cover 50 so as to change the opening area size of the front suction inlet 46. An upper end portion of the cover 50, for example, may be attached pivotally to the cover case 41 via the shaft 44 leaving a lower end portion rotating freely. The moving means for moving the cover 50 includes the shaft 44 and a spring 45 etc.

When the cover 50 is contacted with and pushed by a wall or furniture, it rotates so as to make the opening area of the front suction inlet 46 smaller, in other words, to narrow it.

Independent from the variation on the opening area size of the front suction inlet 46, the adjusting mechanism is configured to vary the size of the front suction inlet, in particular, to make it smaller by rotating the lower end portion of the cover 50 backward to allow at least one part of the cleaning members of the rotary cleaning body 35 protruding ahead of the suction inlet main body 31 via the front suction inlet 46 when the front of the cover 50 is pressed against the wall or furniture.

As shown in FIG. 4, in order to make a forward protrusion amount larger, the cover 50 extends obliquely downward, protruding out from the concave section 42 and the front suction inlet 46 ahead of the front end surface Va of the bumper V. Also, at both sides of the cover 50 there formed are side wall sections 51 and 51, occluding an interspace formed between two edge sections of the cover 50 and two edge sections of the concave section 42 and the front suction inlet 46.

A holding section 52 is formed at an inner side of the upper section of the cover 50, held by and rotatable around the shaft 44. The upper end 50*b* of the cover 50 is contacting with an upper edge portion 42*a* of the concave section 42 of the cover case 41, inhibiting a counterclockwise rotation of the cover 50 around the shaft 44 from a position shown in FIG. 4, in other words, only allowing a clockwise rotation from the position shown in FIG. 4. On an anterior surface of the cover 50, a plurality of protruding strips 53 extending to either side are formed, resulting in concave and convex portions on the anterior surface of the cover 50.

The cover 50, made from soft resin materials, will not scratch furniture etc and also function as a bumper to protect the suction inlet unit 30.

A pair of springs 45 are disposed at the shaft 44, biasing the cover 50 counterclockwise (as shown in FIG. 4) to maintain it in a position as shown in FIG. 4. More specifically, when the cover 50 is in an open state, height H1 from the cleaning surface Y to the lower end portion 50*a* of the cover 50 and an interspace S from the front end wall sections 40Da and 40Ea to the lower end portion 50*a* of the cover 50 are maximum, and the cleaning members 35A of the rotary cleaning body 35 can not protrude outside from the front suction inlet 46.

When the cover 50 is pressed backward against the biasing force of the springs 45, it rotates clockwise (as shown in FIG. 4) around the shaft, that is, the height H1 becomes smaller and the interspace S no longer exists.

Figure 9:
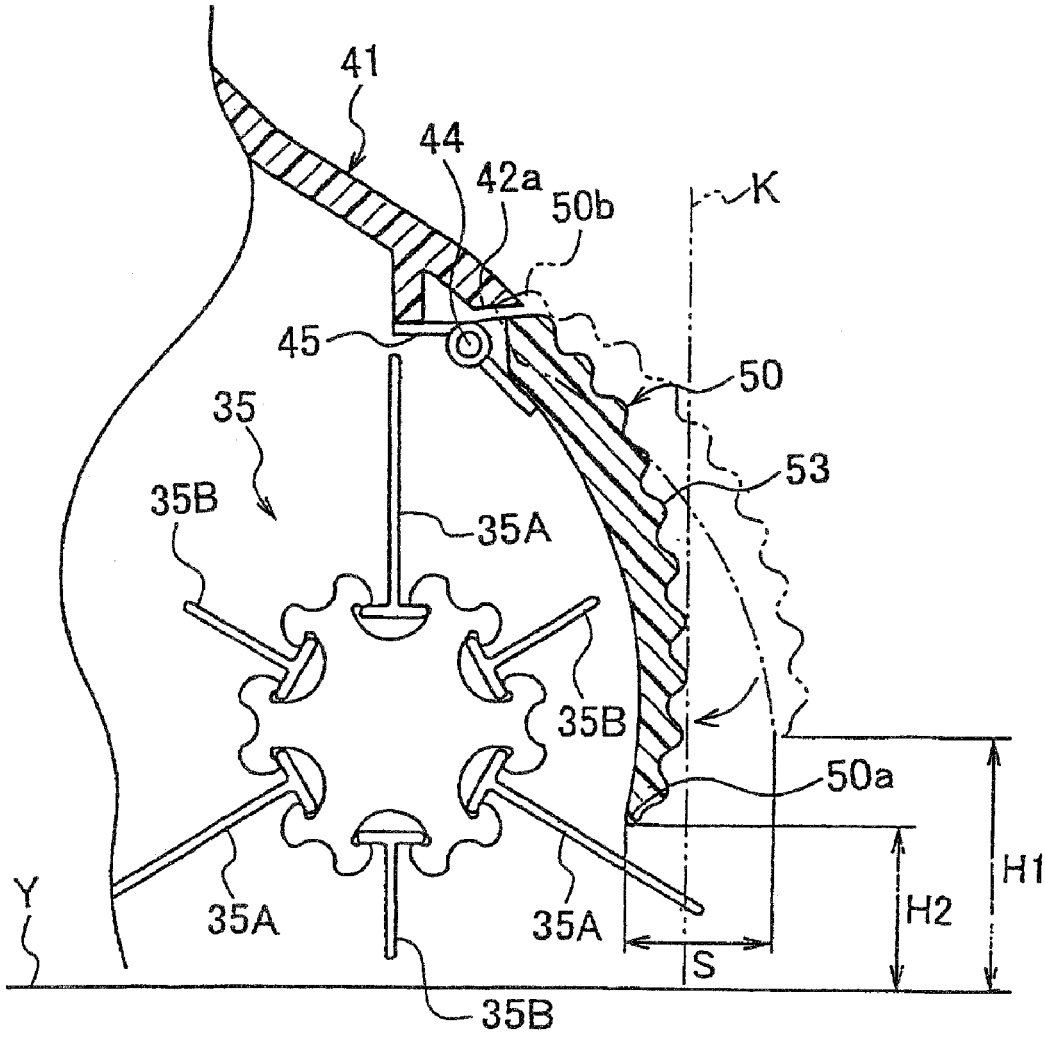
FIG. 9 is an explanatory view illustrating a state of the cleaning member of the rotary cleaning body protruding ahead of the cover.
Figure 10:
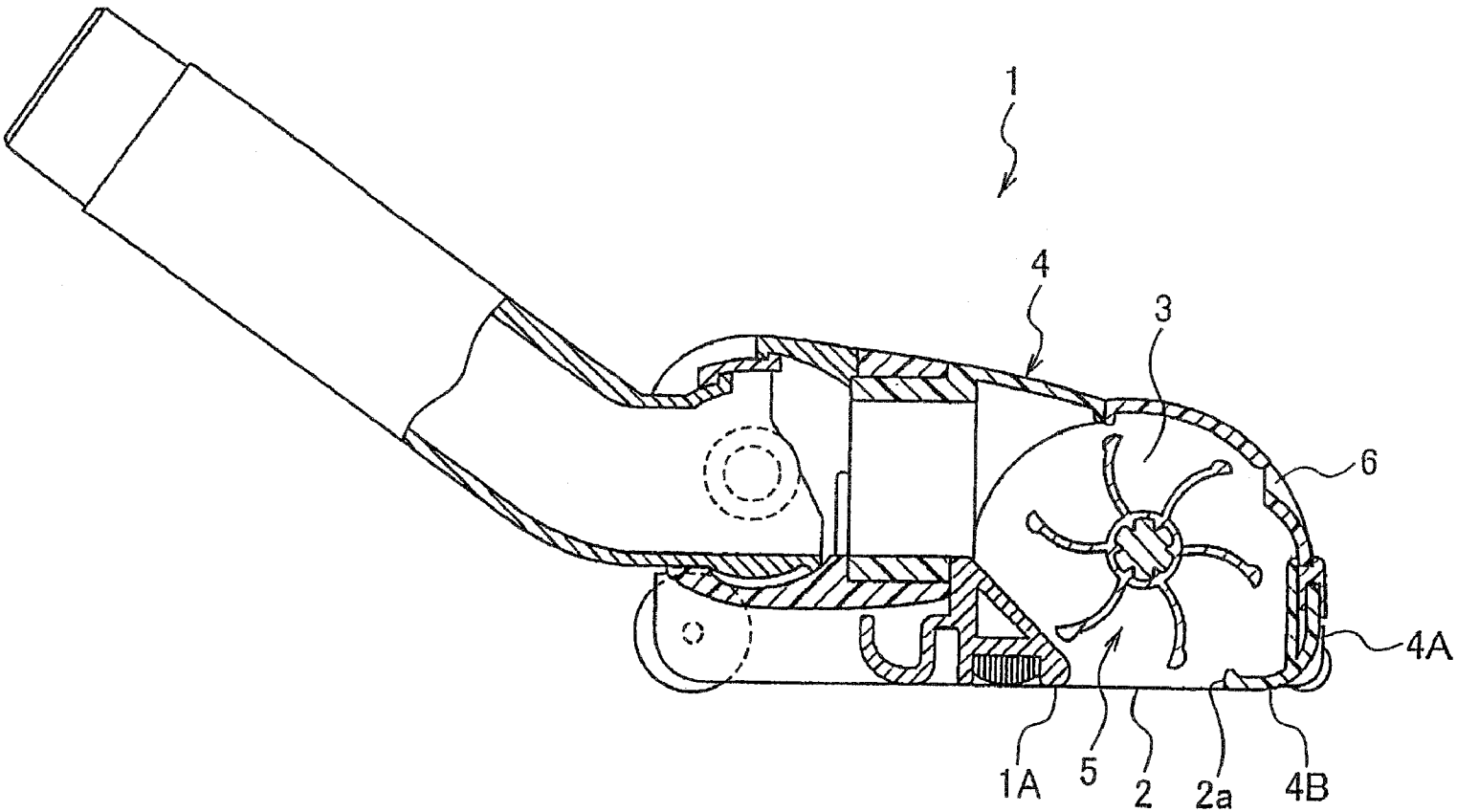
FIG. 10 PRIOR ART
FIG. 10 is an explanatory view showing a configuration of a conventional suction inlet unit.

And in this state, at least one part of the cleaning members of the rotary cleaning body 35, for example, the cleaning members 35A only can protrude outside from the front suction inlet 46 ahead of the suction inlet main body 31 (see FIG. 9).

Operations of the electric vacuum cleaner 20 and the suction inlet unit with the configuration described above will be explained hereinafter.

As shown in FIG. 1, first, the hose 22 is connected to the vacuum cleaner main body 21 to which the suction inlet unit 30 is connected via the extension tube 24 attached to the hand-held operating pipe 23 of the hose 22. When the switches (not shown) on the hand-held operating pipe 23 are operated, the electric air blasting machine is driven to draw in air and the dust entrained in air from the bottom suction inlet 32 of the suction inlet unit 30.

The sucked dust and air are drawn in to the dust collecting chamber 25 of the vacuum cleaner main body 21, passing through the extension tube 24 and the hose 22. The dust and the air are separated in the dust collecting chamber 25, the separated dust are accumulated in the dust collecting chamber 25 and the air is discharged by the electric air blasting machine.

On the other hand, the motor of the suction inlet unit 30 is driven to rotate the rotary cleaning body 35. When the suction inlet unit 30 is moved forward, since the height H1 from the cleaning surface Y to the lower end portion 50*a* of the cover 50 is maximum, the dust on the cleaning surface Y will not be pushed forwards by the cover 50, therefore, the dust on the cleaning surface Y will be efficiently sucked by the front suction inlet 46 and the bottom suction inlet 32 of the suction inlet unit 30.

Even in a case that the cleaning surface Y is a carpet etc, since the lower end portion 50*a* of the cover 50 is in a high position, even though the suction inlet unit 30 subsides in the shaggy carpet during the advancement, it is less possible that the shags of the carpet may contact with the cover 50. Therefore, when the suction inlet unit is moved forward, resistance (load) is small, thus the advancing operation of the suction inlet unit 30 can be conducted easily and smoothly.

Figure 8:
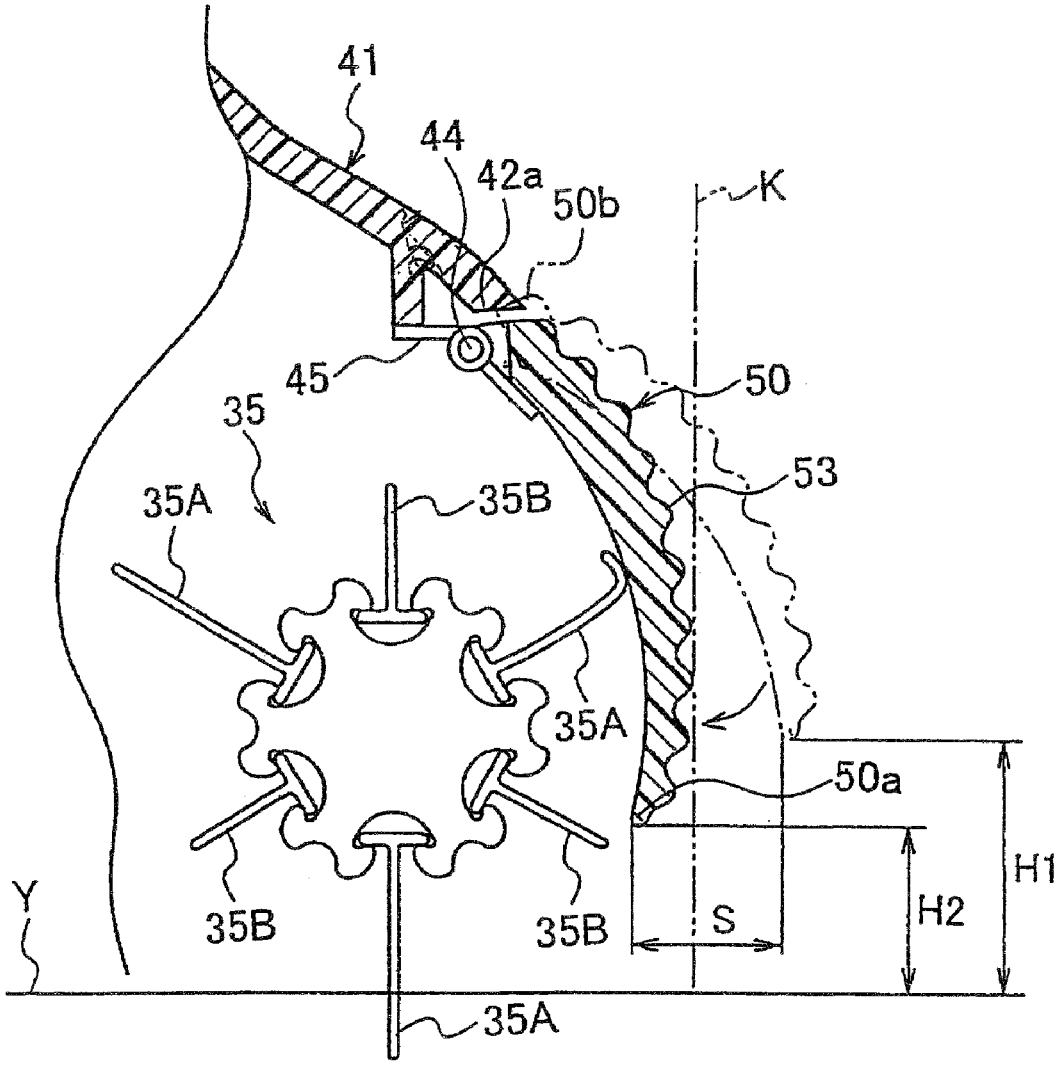
FIG. 8 is an explanatory view illustrating a contacting state between a rotating cleaning member of the rotary cleaning body and the inner side of the cover case.

As shown in FIG. 8, when the suction inlet unit 30 is advanced forward to press the cover 50 against the wall K, if the front end surface Va of the bumper V of the suction inlet unit 30 is contacted with and pushed by the wall K, the cover 50 rotates clockwise (as shown in FIG. 4) around the shaft 44 against the biasing force of the springs 45. As a result of this, the height from the cleaning surface Y to the lower end portion 50*a* of the cover 50 decreases to a height H2, which is smaller that H1. Moreover, the interspace S from the front end wall sections 40Da and 40Ea to the lower end portion 50*a* of the cover 50 no longer exists. In other words, the lower end portion 50*a* of the cover 50 is made recessing.

Thus, the opening area of the front suction inlet 46 of the suction inlet main body 31 becomes narrow, resulting in the increase of the sucking force of the front suction inlet 46, and consequently, increasing the sucking force to the dust near the wall K, which enables an efficient cleaning of the wall K.

Moreover, as shown in FIG. 8, when the cover 50 retracts from a position of dot-dashed line to another position of solid line, which narrows the opening area of the front suction inlet 46, the cleaning members 35A of the rotary cleaning body 35 protrude ahead of the suction inlet main body through the front suction inlet 46 and beat the dust near the wall K which are sucked in mainly by the front suction inlet 46. This and the increased sucking force of the front suction inlet 46 described above are combined to give a fast and efficient suction of the dust.

Furthermore, as shown in FIG. 9, the cleaning members 35A of the rotary cleaning body 35 protrude ahead of the cover 50, the dust near the wall K can be certainly scraped out by the cleaning members 35A and the wall K can be cleaned for sure.

Also, when the cover 50 is rotated toward the rotary cleaning body 35, only the flexible and longer cleaning members 35A contact with the inner side of the cover 50 while the brushes 35B with strong beating force make no contacts, the load to the rotation of the rotary cleaning body 35 is small and will not weaken the rotation force of the rotary cleaning body 35. Therefore, in the case when a plurality of cleaning members with different length and category are disposed in the rotary cleaning body 35, the weakening to the rotation force of the rotary cleaning body 35 can be avoided even if a plurality of the cleaning members are contacting with the inner side of the cover 50 provided that at least the cleaning members with strong drape (strong beating force) are not.

A plurality of protruding strips 53 extending to either side resulting in concave and convex portions are disposed on the anterior surface of the cover 50. Thus, while the cover is contacted with and pushed by the wall K and the suction inlet unit 30 is moved along the wall K for a cleaning, since contacting area between the wall K and the cover 50 is small and the convex portions contacting the wall K are extending from side to side, thus, the moving operation on the suction inlet unit 30 is extremely laborsaving.

In the above embodiment, a plurality of protruding strips 53 are formed on the anterior surface of the cover 50 extending horizontally. However, it is also preferable that the plurality of protruding strips 53 are formed extending vertically and have a stronger hardness than that of the cover 50.

In this embodiment, the cover 50 is attached to the cover case 41. It is also preferable for a suction inlet unit without the cover case 41 to have the cover 50 attached to any wall section of the suction inlet unit. Moreover, the cover 50 is disposed with its upper end portion rotating around the shaft 44, it is also preferable to dispose it moving in a upward and downward direction.

In this case, as the front of the suction inlet main body 31 contacts with a wall, the cover 50 descends to decrease the opening area of the front suction inlet 46, and when it leaves away from the wall, the cover 50 ascends to increase the opening area of the front suction inlet 46.

Moreover, it is preferable that the cover 50 is disposed having a parallel translation from a front to back position with respect to the suction inlet main body 31. In this case, when the cover 50 is contacted with the wall it retracts, and as a result of this retraction, the front ends of cleaning members 35A of the rotary cleaning body may protrude out through the front suction inlet.

As described above, the suction inlet unit having the bottom suction inlet 32 formed in the bottom surface 31A of the suction inlet main body 31 comprises the front suction inlet 46 formed continuously with the bottom suction inlet 32 in the front of the suction inlet main body 31, and the adjusting mechanism disposed for adjusting the biased cover 50 so that the front suction inlet 46 can open in a determined opening area. When the front of the suction inlet main body 31 encounters the wall or furniture, the lower end portion 50*a* of the cover 50 descends, causing the cover 50 to narrow the opening area of the front suction inlet 46, thus the dust sucking force is increased. Therefore, the dust on the cleaning surface can be efficiently sucked without being pushed forwards when the suction inlet main body 30 is moved forward.

The suction inlet unit further comprises the suction inlet main body 31 having the suction chamber 33 with the suction inlet 32 formed in the bottom surface 31A, the rotary cleaning body 35 disposed rotating freely in the suction chamber 33 and having cleaning members 35A and 35B, the front suction inlet 46 formed in the front of the suction inlet main body 31 continuously with the bottom suction inlet 32, and the movable cover 50 forming one part of the wall section of the front suction inlet. When the front portion of the suction inlet main body 31 is contacted with and pushed by the wall or furniture etc, the cover 50 is pressed to retract, making at least one part of the cleaning members 35A of the rotary cleaning body 35 protrude ahead of the suction inlet main body 31 through the front suction inlet 46. Therefore, the dust near the wall K are surely beaten out and cleaned by the cleaning members 35A.

INDUSTRIAL APPLICABILITY

In the above embodiment, the suction inlet unit according to the present invention has been described with application in the electric vacuum cleaner, but the suction inlet unit according to the present invention, which increases the sucking force by decreasing the opening area of the suction inlet in use is not limited in its application in the electric vacuum cleaner, it is also applicable in other fields, for example, in an air conditioning apparatus.

What is claimed is:

1. A suction inlet unit comprising:

a suction inlet main body having a suction chamber with a bottom suction inlet, a rotary cleaning body provided rotatably in said suction chamber and having a cleaning member, a front suction inlet formed continuously with said bottom suction inlet in front of said suction inlet main body, and an adjusting mechanism for adjusting at least a first part of a front wall section forming said front suction inlet so as to control a forward protrusion, through said front suction inlet, of at least a part of said rotary cleaning member, wherein when said adjusting mechanism is contacted with and pushed by an obstruction, an opening area of the front suction inlet decreases and said part of said rotary cleaning member protrudes forward through said front suction inlet, and wherein the adjusting mechanism does not adjust at least a second part of the front wall section, the second part comprising a non-rotatable front end surface of a bumper.

2. The suction inlet unit set forth in claim 1, wherein the cleaning member of said rotary cleaning body rotates from a front to a back position to clean a cleaning surface.

3. The suction inlet unit set forth in claim 1, wherein said rotary cleaning body includes a pivot section and a plurality of cleaning members with different lengths are provided along a circular direction around the pivot section with spacing, and wherein longer cleaning members are configured to be more flexible than shorter cleaning members.

4. The suction inlet unit set forth in claim 1, wherein the first part of the front wall section forming said front suction inlet includes a cover which covers at least a part of the front suction inlet, and wherein said adjusting mechanism adjusts the opening area of said front suction inlet by moving said cover to a position between a wide opening area position and a narrow opening area position.

5. The suction inlet unit set forth in claim 1, wherein said cover has an upper end portion attached to said suction inlet main body and a lower end portion which is rotatable, and when said cover is contacted with and pushed by the obstruction, the lower end portion is rotated for protruding said part of the said cleaning member ahead of said front suction inlet.

6. The suction inlet unit set forth in claim 4, wherein said cover is made from soft resin materials.

7. The suction inlet unit set forth in claim 5, wherein said cover is made from soft resin materials.

8. The suction inlet unit set forth in claim 4, wherein convex and concave portions are disposed on a surface of said cover.

9. The suction inlet unit set forth in claim 5, wherein convex and concave portions are disposed on a surface of said cover.

10. An electric vacuum cleaner comprising:

a vacuum cleaner main body having a dust collecting chamber;

a suction inlet unit; and a connector which detachably connects the vacuum cleaner main body to the suction inlet unit;

wherein the suction inlet unit comprises:

a suction inlet main body having a suction chamber with a bottom suction inlet, a rotary cleaning body provided rotatably in said suction chamber and having a cleaning member, a front suction inlet formed continuously with said bottom suction inlet in front of said suction inlet main body, and an adjusting mechanism for adjusting at least a first part of a front wall section forming said front suction inlet so as to control a forward protrusion, through said front suction inlet, of at least a part of said rotary cleaning member, wherein when said adjusting mechanism is contacted with and pushed by an obstruction, an opening area of the front suction inlet decreases and said part of said rotary cleaning member protrudes forward through said front suction inlet, and wherein the adjusting mechanism does not adjust at least a second part of the front wall section, the second part comprising a non-rotatable front end surface of a bumper.

* * * * *